United States Patent [19]

Dickson et al.

[11] 4,381,943

[45] May 3, 1983

[54] CHEMICALLY HOMOGENEOUS MICROCRYSTALLINE METAL POWDER FOR COATING SUBSTRATES

[75] Inventors: James Dickson, Stirling; Louis F. Nienart, Bloomsbury; David W. H. Roth, Jr., Convent Station, all of N.J.

[73] Assignee: Allied Corporation, Morris Township, Morris County, N.J.

[21] Appl. No.: 285,881

[22] Filed: Jul. 22, 1981

[51] Int. Cl.[3] ..... B22F 1/00

[52] U.S. Cl. ..... 75/2.51; 75/123 B; 75/0.5 BA; 420/435; 420/441; 420/459

[58] Field of Search ..... 75/251-255, 75/0.5 A, 0.5 AA, 0.5 AC, 0.5 B, 0.5 BA, 0.5 BC, 0.5 C, 123 B, 170, 123 D; 148/31.55

[56] References Cited

U.S. PATENT DOCUMENTS

| | | | |
|---|---|---|---|
| 3,856,513 | 12/1974 | Chen et al. | 75/122 |
| 4,063,942 | 12/1977 | Lundgren | 75/251 |
| 4,069,045 | 1/1978 | Lundgren | 75/251 |
| 4,197,146 | 4/1980 | Frischmann | 148/31.55 |
| 4,221,587 | 9/1980 | Ray | 75/0.5 C |
| 4,264,641 | 3/1981 | Mahoney et al. | 427/30 |
| 4,290,808 | 9/1981 | Ray | 75/251 |
| 4,297,135 | 10/1981 | Giessen et al. | 75/123 B |
| 4,304,593 | 12/1981 | Maeland | 75/0.5 R |
| 4,318,733 | 3/1982 | Ray et al. | 75/0.5 BA |

OTHER PUBLICATIONS

Ray, Ranjan, "Bulk Microcrystalline Alloys Prepared From Metallic Glasses-A Novel Materials Technology," Materials Science and Engineering, V52, pp. 85-87, Jul. 1981.

*Primary Examiner*—L. Dewayne Rutledge
*Assistant Examiner*—Christopher W. Brody
*Attorney, Agent, or Firm*—Gerhard H. Fuchs; Michael J. Weins

[57] ABSTRACT

The present invention is a chemically homogeneous microcrystalline powder for deposition onto a substrate. The powder is a B containing alloy based in Fe, Ni, Co or a combination thereof.

6 Claims, No Drawings

CHEMICALLY HOMOGENEOUS MICROCRYSTALLINE METAL POWDER FOR COATING SUBSTRATES

FIELD OF INVENTION

The present invention relates to a powder for coating substrates, and more particularly to a chemically homogeneous microcrystalline metal powder.

PRIOR ART

It has been known that metals can be deposited onto a substrate to produce a coating that provides enhanced wear and corrosion resistance. Metal coatings were frequently made using highly alloyed powders which were fused onto the substrate. The coatings produced by these powders were frequently multiphased, and consisted of a hard intermetallic abrasive resistant material in a more ductile matrix.

Many of the prior art powders used to form coatings have compositions that can form in the amorphous state if the cooling rate is sufficiently rapid. These alloy powders have, however, been produced in a multiphase crystalline state for coating.

U.S. Pat. No. 3,322,546 teaches typical prior art compositions used for coating. The powders of these compositions were obtained by mechanically blending crystalline powders of various compositions, and then processing the mixture to produce crystalline powders for coating. The processed powders produced a coating with a multiphase crystalline structure.

Methods for better homogenizing powders used for coatings are taught in U.S. Pat. No. 4,118,527 where the individual crystalline ingredients are physically combined together in intimate contact.

Atomization techniques, such as those discussed in U.S. Pat. No. 4,124,737 have been employed to homogenize powders. The degree of homogenization obtained by this technique has not been established. The atomized powders of U.S. Pat. No. 4,124,737 had no strong precipitation formers, such as B, to cause precipitates to form in the coating. For this reason it might be possible to make these compositions into homogeneous powders. It was reported in the examples that these atomized powders were 325 Tyler mesh or finer.

U.S. Pat. No. 4,192,672 extends the teachings on atomization of powder to include boron containing alloys. The patent reports that typical atomized spray-and-fuse boron containing nickel powders have a distribution of fine borides. The patent goes on to teach that the powders should be about 100 Tyler mesh or finer for spray-and-fuse self-fluxing alloys.

The coatings obtained from spraying powders as described above frequently show connected porosity and/or only mechanical interlock between the deposited particles, unless the coating was given a subsequent fusing heat treatment such as described in U.S. Pat. No. 4,192,672.

Wear resistance coatings have been deposited on metal surfaces by such techniques as cathode sputtering. One such technique is taught in U.S. Pat. No. 4,124,472. Normally these techniques are only effective in the forming of very thin coatings, and not used to produce coatings which withstand many types of abrasion wear.

SUMMARY OF INVENTION

The present invention provides a chemically homogeneous microcrystalline powder suitable for coating a substrate. The powders are boron-containing alloy based in Ni, Fe, Co, or combinations thereof. The alloy may optionally contain other metalloids from the group Si, C, P, Al, and Ge.

The alloy powder may further contain additions of Mo, W, Mn, V, Cr, Cu and Ti.

BEST MODE FOR CARRYING THE INVENTION INTO PRACTICE

The powders of the present invention are chemically homogeneous and microcrystalline. It has been found that these powders, although not amorphous, when deposited on a substrate produce a substantially amorphous coating. This amorphous coating is comparable to the coating produced by the amorphous powders of the copending application, U.S. application Ser. No. 06/285,730, assigned to the assignee of the present application. Since amorphous and microcrystalline powders produce comparable amorphous coatings, the properties of the deposit can be predicted from the properties of the amorphous material.

The deposit obtained using the powders of the present invention will be substantially amorphous if the powders employed are chemically homogeneous. Chemically homogeneity for boron containing alloys is determined by the fact that the X-ray pattern is that of a single, supersaturated phase. This technique is further described in the Kapoor, Wan and Wang application, U.S. application Ser. No. 06/220,618, filed Dec. 29, 1980, assigned to the assignee of the present application.

It should be appreciated that the present invention will allow one to start with a microcrystalline material. This reduces limiations on the chemistry and cooling rates necessary to produce the powder of the present invention. It is felt that cooling rates of the order of $10^5$ °C./sec and greater should be sufficient to maintain the chemically homogeneous microcrystalline structure for powders that have a boron content between about 5 at. % to 30 at. % and are based in Ni, Fe, Co or combinations thereof.

The preferred compositions for the powders of the present invention are those disclosed in the Kapoor et al. application and the copending Ray application, U.S. application Ser. No. 06/023,379, filed Mar. 23, 1979, assigned to the assignee of the present application.

Additions such as Cr and Cu will tend to enhance the corrosion resistance of the alloy, while Mo, W, Mn, V and Ti will tend to increase the strength of the alloy.

Metalloids such as Si, C, P, Al, and Ge may be substituted for some of the B. When Si is added, it generally increases the corrosion resistance of the alloy.

When it is desired to produce a coating with high hardness, it is preferred that the chemistry be further restricted to an alloy containing at least ten (10) atomic percent boron.

In order to assure that the powders have a chemically homogeneous microcrystalline structure, it is preferable that the cooling rate be at least about $10^5$ °C./sec during solidification of the molten metal. This cooling rate is not generally obtainable by atomization techiques. If atomized powders, such as those described in U.S. Pat. No. 4,192,672, are employed, the powders will have at least two phases, a metallic solid solution, and a boride. The boride appears to survive the remelting associated with arc plasma spraying. The borides contained in the powder cause the hard-faced surface to be two phase.

The two phase surface is softer than an amorphous surface of the same composition.

It is preferred that the powders of the present invention be produced by casting on a moving chill surface. The casting is then fragmented into powder. These homogeneous microcrystalline materials are brittle and can be fragmented by jet milling and the like. Methods for amorphous reducing rapidly solidified material to powder are taught in another Ray application U.S. application Ser. No. 06/023,411 now U.S. Pat. No. 4,290,808, assigned to the assignee of the present application.

The powders formed by rapid solidification onto a chill surface, as taught in the Ray applications U.S. applications Ser. Nos. 06/023,379 and 06/023,411, now U.S. Pat. No. 4,290,808, both filed Mar. 23, 1979, and assigned to the assignee of the present application, have the advantage of a low oxygen content, when compared to powders made by other powder metallurgy techniques. A low oxygen content is desirable since it may minimize the problem of the fluxing by boron, and therefore, the depletion of boron from the resulting deposit.

In order to illustrate the merits of the powder of the present invention, blends of powder having the mesh size distribution given in Table I were prepared and arc plasma sprayed. The oxygen content of these powders was typically less than 100 ppm.

TABLE I

| Distribution of Particle Size in Powders | | |
|---|---|---|
| | Mesh Ranges | |
| BLEND | Particle Size Range Tyler sieve | Percentage of Powder within the Range |
| A | −80 to +100 | 15 |
| | −100 to +270 | 65 |
| | −270 to +325 | 15 |
| | −325 | 5 |
| B | −170 to +270 | 100 |

The following examples illustrate some of the properties which can be obtained by employing the powders of the present invention.

EXAMPLE I

Powder blend A having a composition:

$Ni_{57.5}Fe_9Mo_{23.5}B_{10}$ by atomic percent was arc plasma sprayed onto a 4 in. by 4 in. by 0.25 in. mild steel coupon. Prior to coating, the coupon surfaces were blasted with No. 25 steel grit and subsequently cleaned using a degreasing solvent, 1,1-trichloroethane.

The powder was chemically homogeneous and microcrystalline and produced by fracturing cast ribbon and jet milling the fragments.

The torch used to deposit the powder was an AVCO PG-100 with a 901065-1 anode.

The operating parameters for the torch were as follows:

Voltage: 29 volts
Amps: 860
Power: 25 kw
Flow rate, and Carrier Gas: A 8 cfm
Flow rate, and Plasma Gases:
A 60 cfm,
He 15 cfm
Distance from torch to substrate: 6 inches The resulting deposit was 10 mils thick. The bond strength between the substrate and the deposit was 6900 psi. The deposit was sectioned and showed no indication of interconnected porosity. The coating had a density of 98%. The surface roughness of the deposit was less than 199 micro inches rms. The coating had a Vickers hardness of 1000 kg/mm$^2$ with a load of 100 grams. The coating was boride free and 39% amorphous as determined by X-ray analysis.

EXAMPLE II

Powder blend B having a composition:

$Ni_{57.5}Fe_9Mo_{23.5}B_{10}$ by atomic percent was deposited as set forth in Example I. The powder was chemically homogeneous and microcrystalline.

The torch used to deposit the powder was the same as used for Example I. The operating parameters were the same with the following exceptions:

Voltage: 27 volts
Amps: 575
Power: 15.5 kw

The resulting deposit was 10 mils thick. The bond strength between the substrate and the deposit was 2400 psi. The deposit was sectioned and showed no indication of interconnected porosity. The density of the deposit was 91.5%. The surface roughness of the deposit was less than 235 micro inches rms. The hardness was 1000 kg/mm$^2$ Vickers with a load of 100 grams. The coating was boride free and 69% amorphous as determined by X-ray analysis.

EXAMPLE III

The procedure for Example I and II was followed with the exception that the operating conditions for the torch were modified as follows:

Voltage: 27 volts
Amps: 575
Power: 15.5 kw
Flow rate, and Carrier Gas: A 9 cfm
Flow rate, and Plasma Gases:
A 40 cfm,
$H_2$ 10 cfm
Distance from torch to substrate: 4 in.

The resulting deposit was 20 mils thick. The surface hardness was 1000 kg/mm$^2$ Vickers with a load of 100 grams. The coating was boride free and 77% amorphous as determined by X-ray analysis.

It should be understood that for the above examples, the powders were used to arc plasma spray, however, other coating techniques, such as vacuum arc plasma spraying, flame spraying and laser glazing may be employed.

What we claim is:

1. A boron containing metal powder for deposit onto a substrate to form a boride-free continuous coating which is bonded to the substrate and free from interconnected porosity comprising a chemically homogeneous microcrystalline powder having Ni, Fe, Co or a combination thereof as a base and which contains between about 5 at % and 30 at % B; said powder is in platelet form having an outline formed by fracture and having a particle size distribution such that said powder will pass through an 80 mesh (Tyler) screen and less than half of said powder will pass through a +270 mesh screen.

2. The metal powder of claim 1 wherein said chemically homogeneous alloy has additions consisting essentially of metalloids from the group of Si, C, P, Al, and Ge and alloying elements from the group of Mo, W, Mn, V, Cr, Cu, and Ti.

3. The metal powder of claim 2 where said additional metalloid is Si.

4. The metal powder of claim 1 or 2 wherein said powder is formed by fracture of planar sheets of uniform thickness, said thickness being less than 100 microns, and said powder having a fraction of its particles of a size that will pass through an 80 mesh screen but not a 100 mesh screen.

5. The metal powder of claim 4 wherein the oxygen content of the powder is less than 100 ppm.

6. The metal powder of claim 1 or 2 wherein the boron level is at least 10 at %.

* * * * *